US007230885B2

(12) United States Patent
Sakurazawa et al.

(10) Patent No.: US 7,230,885 B2
(45) Date of Patent: Jun. 12, 2007

(54) WRIST WATCH CASE, WRIST WATCH WITH AUTO TIME ADJUSTING FUNCTION BY ELECTRIC WAVE, AND WRIST MOUNTABLE ELECTRIC DEVICE CASE

(75) Inventors: Naohiko Sakurazawa, Hamura (JP); Akihiro Sugisawa, Akishima (JP); Yoshihiro Maruyama, Akishima (JP)

(73) Assignee: Casio Computer Co., Ltd., Tokyo (JP)

( * ) Notice: Subject to any disclaimer, the term of this patent is extended or adjusted under 35 U.S.C. 154(b) by 262 days.

(21) Appl. No.: 10/928,468

(22) Filed: Aug. 26, 2004

(65) Prior Publication Data

US 2005/0047282 A1 Mar. 3, 2005

(30) Foreign Application Priority Data

Sep. 1, 2003 (JP) ..... 2003-308478
Apr. 26, 2004 (JP) ..... 2004-129146

(51) Int. Cl.
*G04B 37/00* (2006.01)
*G04C 11/00* (2006.01)

(52) U.S. Cl. ..... 368/88; 368/47

(58) Field of Classification Search ..... 368/47, 368/10, 13, 276, 278; 343/720, 732
See application file for complete search history.

(56) References Cited

U.S. PATENT DOCUMENTS 4,468,134 A * 8/1984 Halicho ..... 368/309
4,993,007 A * 2/1991 Meister ..... 368/294
5,097,679 A * 3/1992 Johnson et al. ..... 63/33
5,631,880 A * 5/1997 Houlihan ..... 368/287
6,657,922 B2 * 12/2003 Sato ..... 368/10
6,666,576 B2 * 12/2003 Kaelin et al. ..... 368/295
6,776,519 B2 * 8/2004 Eleuterio et al. ..... 368/295
6,914,564 B2 * 7/2005 Barras et al. ..... 343/700 MS
2003/0117903 A1 * 6/2003 Nakajima et al. ..... 368/47
2004/0233789 A1 * 11/2004 Oguchi et al. ..... 368/47

* cited by examiner

*Primary Examiner*—Vit W. Miska
*Assistant Examiner*—Sean Kayes
(74) *Attorney, Agent, or Firm*—Frishauf, Holtz, Goodman & Chick, P.C.

(57) ABSTRACT

A wrist mountable electronic device case such as a wrist watch case includes: a main body of a synthetic resin, in and on which a housing portion and a pair of band attaching portions are formed, one attaching portion being formed with an antenna containing area; a metallic sheath member mounted on a top surface of the body, having an opening corresponding to a top opening of the housing portion, and not covering the containing area; a light transmitting member mounted on the opening of the sheath member; a metallic back cover covering a bottom opening of the housing portion; and a fixing unit fixing the sheath member and the back cover with each other while sandwiching the main body therebetween. A watch module is housed in the housing portion, an antenna is contained in the containing area, and a lead connects the antenna to the watch module.

16 Claims, 7 Drawing Sheets

WRIST WATCH CASE, WRIST WATCH WITH AUTO TIME ADJUSTING FUNCTION BY ELECTRIC WAVE, AND WRIST MOUNTABLE ELECTRIC DEVICE CASE

CROSS-REFERENCE TO RELATED APPLICATIONS

This application is based upon and claims the benefit of the prior Japanese Patent Applications No. 2003-308478, filed Sep. 1, 2003; and No. 2004-129146, filed Apr. 26, 2004, the entire contents of both of which are incorporated herein by reference.

BACKGROUND OF THE INVENTION

1. Field of the Invention

The present invention relates to a wrist watch case, a wrist watch with an auto time adjusting function by an electric wave, and a wrist mountable electric device case.

2. Description of the Related Art

Conventionally, a wrist watch with an auto time adjusting function by an electric wave, in which an antenna is incorporated in its wrist watch case, has been well known. This wrist watch is configured so as to receive an electric wave including a standard time data by the incorporated antenna, pick up the standard time data from the received electric wave, and then, correct a time displayed on the wrist watch on a basis of the picked up standard time data. As described in the specification of U.S. Pat. No. 6,657,922, the wrist watch case is made of a synthetic resin so that the wrist watch case does not prevent the antenna from receiving the electric wave.

There is a demand for reducing the entire thickness of the wrist watch with an auto time adjusting function by an electric wave. However, since the wrist watch case is formed of the synthetic resin, the reduction of the thickness of the wrist watch makes the strength of the case be reduced. In addition, the external appearance of the watch case is poor.

BRIEF SUMMARY OF THE INVENTION

According to one aspect of the present invention, a wrist watch case comprises: a case main body made of a synthetic resin, in which a housing portion with top and bottom openings is formed, and on which a pair of band attaching portions are formed to project from the case main body, at least one of the band attaching portions being formed with an antenna containing area; a metallic sheath member which is mounted on a top surface of the case main body and has an opening corresponding to the housing portion, the sheath member not covering the antenna containing area of the at least one of the band attaching portions; a light transmitting member which is mounted on the opening of the sheath member; a metallic back cover which covers the bottom opening of the housing portion of the case main body; and a fixing unit which fixes the sheath member and the back cover with each other while sandwiching the case main body therebetween.

According to one aspect of the present invention, a wrist watch with an auto time adjusting function by an electric wave, comprises: a wrist watch case including (i). a case main body made of a synthetic resin, in which a housing portion with top and bottom openings is formed, and on which a pair of band attaching portions are formed to project from the case main body, at least one of the band attaching portions being formed with an antenna containing area and a communication passage communicating the antenna containing area and the housing portion with each other, (ii). a metallic sheath member which is mounted on a top surface of the case main body and has an opening corresponding to the housing portion, the sheath member not covering the antenna containing area of the at least one of the band attaching portions, (iii). a light transmitting member mounted on the opening of the sheath member, (iv). a metallic back cover which covers the bottom opening of the housing portion of the case main body, and (v). A fixing unit which fixes the sheath member and the back cover with each other while sandwiching the case main body therebetween; a watch module which is housed in the housing portion of the case main body; an antenna which is contained in the antenna containing area; and a lead which is housed in the communication passage and connects the antenna to the watch module.

According to one aspect of the present invention, a wrist mountable electronic device case, comprises: a case main body made of a synthetic resin, in which a housing portion with top and bottom openings is formed, and on which a pair of band attaching portions are formed to project from the case main body, at least one of the band attaching portions being formed with an antenna containing area; a metallic sheath member which is mounted on a top surface of the case main body and has an opening corresponding to the housing portion, the sheath member not covering the antenna containing area of the at least one of the band attaching portions; a light transmitting member mounted on the opening of the sheath member; a metallic back cover which covers the bottom opening of the housing portion of the case main body; and a fixing unit which fixes the sheath member and the back cover with each other while sandwiching the case main body therebetween.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

[First Embodiment]

A wrist watch with an auto time adjusting function by an electric wave, the wrist watch using a wrist watch case in accordance with a first embodiment of the present invention, will be described with reference to FIGS. 1 and 2.

Figure 1:
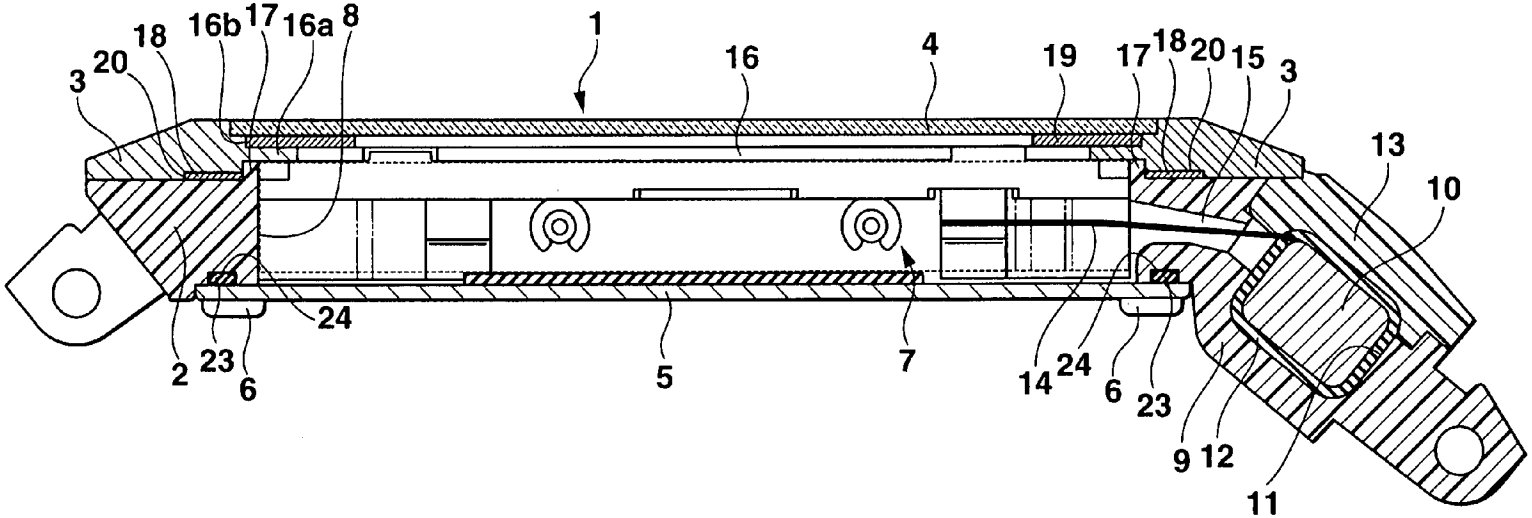
FIG. 1 is a vertical sectional view of a wrist watch with an auto time adjusting function by an electric wave, the wrist watch using a wrist watch case in accordance with a first embodiment of the present invention.
Figure 2:
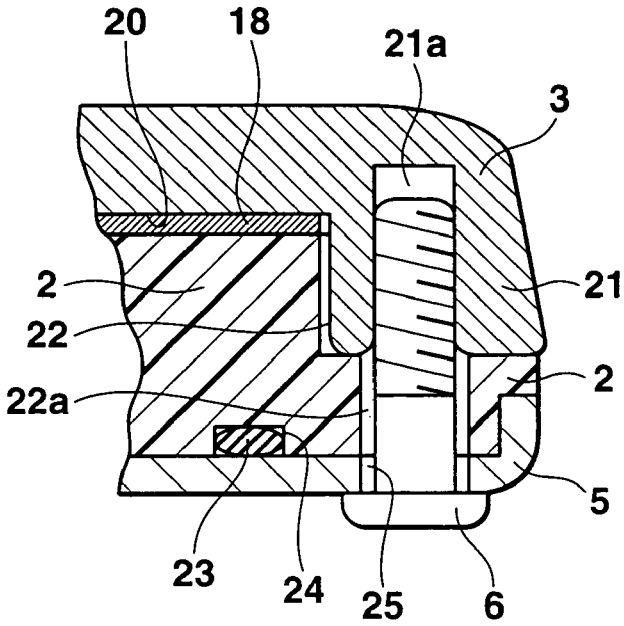
FIG. 2 is an enlarged vertical cross section of an essential part of the wrist watch case of FIG. 1.

FIG. 1 is a vertical cross sectional view of the wrist watch, and FIG. 2 is an enlarged vertical cross sectional view of an essential part of the wrist watch. The wrist watch comprises a wrist watch case 1 as shown in FIG. 1. The wrist watch case 1 comprises: an annular case main body 2 which is made of a synthetic resin and which has top and bottom openings; a metallic bezel 3 which is mounted on a top surface of the case main body 2 and which surrounds the top opening of the case main body 2; a watch glass 4 mounted in a center opening of the bezel 3; a metallic back cover 5 which is mounted on a bottom surface of the case main body 2 and which covers the bottom opening of the case main body 2; and a fixing unit which has a plurality of fixing screws 6 for fixing the back cover 5 and the bezel 3 with each other while sandwiching the case main body 2 between the back cover 5 and the bezel 3.

The case main body 2 is made of, for example, an ABS resin. As shown in FIG. 1, the center hole of the case main body 2 provides a module housing portion 8 which houses a watch module 7 is provided. The case main body 2 has an extending portion 9 which extends laterally and outwardly from the bezel 3 (at a right side of the case main body 2 in FIG. 1). In this embodiment, the extending portion 9 is one of a pair of band attaching portions formed on the case main body 2. An antenna containing area 11 which contains an antenna 10 is formed in the extending portion 9, and the antenna containing area 11 is opened in a top surface of the extending portion 9.

The antenna 10 is configured to receive an electric wave which includes a time data. The antenna 10 is contained in the antenna containing area 11 while it is enveloped with a buffer member 12 such as, for example, a rubber, and a cover panel 13 made of a synthetic resin covers a top opening of the antenna containing area 11. A communication passage 15 which communicates the antenna containing area 11 with the module housing portion 8 is provided in the case main body 2, and a connection lead 14 which electrically connects the antenna 10 to the watch module 7 in the module housing portion 8 is arranged in the communication passage 15.

The bezel 3 is formed of a metal with a high rigidity such as, for example, a stainless steel, and an opening 16 which corresponds to the module housing portion 8 of the case main body 2 is formed in a center portion of the bezel 3.

The entire bezel 3 has a frame shape which is thin in thickness. The position of the bezel 3 on the top surface of the case main body 2 is restricted by a positioning projection 17 which is annually provided along the periphery of the top opening of the module housing portion 8 on the top surface of the case main body 2, so that the bezel 3 is arranged concentrically with respect to the top opening of the module housing portion 8. And, the bezel 3 is adhesively bonded to the top surface of the case main body 2 by a double coated adhesive tape 18.

The bezel 3 has an inner flange 16*a* on an inner periphery of the opening 16, and the inner flange 16*a* protrudes in the top opening of the module housing portion 8 of the case main body 2. A step 16*b* is further provided along the inner periphery of the opening 16 at an upper side of the inner flange 16*a*. In the opening 16 of the bezel 3, a ring-shaped solar panel 19 is mounted on the inner flange 16*a* in an inner side of the step 16*b*, and the watch glass 4 is mounted over the inner flange 16*a* in an upper side of the step 16*b* so that the watch glass 4 is in contact with the solar panel 19. An edge portion of the top surface of the watch module 7 housed in the module housing portion 8 abuts against a bottom surface of the inner flange 16*a*.

As shown in FIG. 1, a tape receiving recess 20 which receives the double coated adhesive tape 18 is formed on the bottom surface of the bezel 3. The tape receiving recess 20 is configured to have a depth which is slightly shallower than the thickness of the double coated adhesive tape 18. Further, as shown in FIG. 2, a plurality of fixing projections 21 are projected downwardly at a plurality of positions, for example, at four positions which are spaced equidistantly from each other, on the bottom surface of the bezel 3. The fixing projections 21 are arranged in a plurality of fixing recesses 22 which are provided on the top surface of the case main body 2 to correspond to the fixing projections 21 of the bezel 3. As shown in FIG. 2, a blind screw hole 21*a* is formed in each fixing projection 21 and is opened on a bottom end of each fixing projection 21. A through hole 22*a* is formed in each fixing recess 22 of the case main body 2 to correspond to the screw hole 21*a*.

The back cover 5 is formed of a metal with a high rigidity such as, for example, a stainless steel or a titanium, and is formed in a substantially flat shape which is thin in thickness, as shown in FIG. 1. The back cover 5 is fixed on the bottom surface of the case main body 2 by the fixing screws 6 with a water proof ring 23 being arranged between the back cover 5 and the bottom surface of the case main body 2. The water proof ring 23 is arranged in a ring shaped groove 24 which is formed in the bottom surface of the case main body 2 along the periphery of the bottom opening of the module housing portion 8. The water proof ring 23 is elastically compressed between the back cover 5 and a bottom end of the ring shaped groove 24 in the bottom surface of the case main body 2 while the back cover 5 is fixed on the bottom surface of the case main body 2. The fixing screws 6 are inserted into a plurality of through holes 25, which are formed in the back cover 5, from a bottom side of the back cover 5 toward a top side thereof, are passed through the through holes 22*a* of the fixing recesses 22 of the case main body 2, and are screwed into the screw holes 21*a* of the fixing projections 21 on the bottom surface of the bezel 3. Therefore, the fixing screws 6 fix the back cover 5 and the bezel 3 to each other while the case main body 2 is sandwiched therebetween.

Now, an assembly of the wrist watch as described above will be described.

At first, the antenna 10 is enveloped with the buffer member 12 and is contained in the antenna containing area 11 formed in the extending portion 9 of the case main body 2 while the connection lead 14 of the antenna 10 is arranged in the communication passage 15 of the case main body 2 to be inserted into the module housing portion 8 of the case main body 2. Next, the cover panel 13 made of a synthetic resin is mounted on the top surface of the extending portion 9 to cover the top opening of the antenna containing area 11. Next, the solar panel 19 and the watch glass 4 are sequentially mounted in the opening 16 of the bezel 3, and the bezel 3 is adhesively bonded on the top surface of the case main body 2 by the double coated adhesive tape 18.

In more detail, the bezel 3 is positioned by the positioning projections 17 provided on the top surface of the case main body 2, and then the bezel 3 is adhesively bonded on the top surface of the case main body 2 by the double coated adhesive tape 18 arranged in the tape receiving recess 20 formed in the bottom surface of the bezel 3.

In this state, the solar panel 19 and watch glass 4 which are mounted in the opening 16 of the bezel 3 correspond to the top opening of the module housing portion 8 of the case main body 2, and the inner flange 16*a* of the opening 16 of the bezel 3 protrudes inwardly from the peripheral edge of the top opening of the module housing portion 8. In addition, the plurality of screw holes 21*a* of the plurality of fixing projections 21 of the bezel 3 correspond to the plurality of through holes 22*a* of the plurality of fixing recesses 22 of the case main body 2.

Next, after the extending end of the connection lead 14 of the antenna 10 is connected to the watch module 7 in the outside of the module housing portion 8 of the case main body 2, the watch module 7 is inserted into the module housing portion 8 of the case main body 2 through the bottom opening of the module housing portion 8, and the peripheral edge portion of the top surface of the watch module 7 is abutted against the bottom surface of the inner flange 16*a* of the bezel 3.

Thereafter, the water proof ring 23 is arranged in the ring groove 24 provided in the bottom surface of the case main body 2, and the back cover 5 is placed on the bottom surface of the case main body 2 to cover the bottom opening of the module housing portion 8. At that time, the plurality of through holes 25 of the back cover 5 are associated with the through holes 22*a* of the plurality of fixing recesses 22 of the case main body 2.

Next, the fixing screws 6 are inserted into the plurality of through holes 25 of the back cover 5 from the bottom side of the back cover 5, and further are inserted into the through holes 22*a* of the plurality of fixing recesses 22 of the case main body 2. Then, the fixing screws are screwed into the screw holes 21*a* of the plurality of fixing projections 21 of the bezel 3. With this screwing, the back cover 5 is pressed onto the water proof ring 23, and the bezel 3 and the back cover 5 are fixed with each other while the case main body 2 is sandwiched therebetween. And, the assembling of the wrist watch terminates.

As described above, in the watch case 1 of the wrist watch with an auto time adjusting function by an electric wave of the present embodiment, the metallic bezel 3 is mounted on the periphery of the top opening of the module housing portion 8 on the top surface of the case main body 2 made of a synthetic resin, and the watch glass 4 and the solar panel 19 are mounted in the opening 16 of the bezel 3. In addition, the metallic back cover 5 is arranged on the bottom surface of the case main body 2 to cover the bottom opening of the module housing portion 8. Finally, while the case main body 2 made of a synthetic resin is sandwiched between the metallic bezel 3 and the metallic back cover 5, the bezel 3 and the back cover 5 are fixed with each other by the plurality of fixing screws 6.

Thus, even if the thickness of the case main body 2 made of a synthetic resin is reduced in order to reduce the entire thickness of the watch case, the rigidity required for the watch case 1 can be obtained by the metallic bezel 3 and the metallic back cover 5. For example, in the watch case 1 of the present embodiment, the entire thickness of the case was successfully reduced to about 5 mm. Because the entire thickness of the watch case of the conventional wrist watch with an auto time adjusting function by an electric wave was about 13 mm, the watch case of the present embodiment can be remarkably reduced in thickness.

In addition, in this watch case 1, the extending portion 9 extending laterally and outwardly from the bezel 3 is formed on the case main body 2 made of a synthetic resin, the antenna containing area 11 is provided in the extending portion 9, and the antenna 10 which is enveloped with the buffer member 12 is contained in the antenna containing area 11. Therefore, the antenna 10 can be located laterally and outwardly from the metallic bezel 3 and the metallic back cover 5, so that the antenna 10 can receive the electric wave which includes the time data well and reliably without being affected by the metallic bezel 3 and the metallic back cover 5.

Further, in this watch case 1, the bezel 3 on which the watch glass 4 and the solar panel 19 have been mounted in advance can be fixed easily and reliably to the case main body 2 by the double coated adhesive tape 18. In addition, since the back cover 5 placed on the bottom surface of the case main body 2 is fixed to the bezel 3 by the plurality of fixing screws 6, the double coated adhesive tape 18 arranged between the bezel 3 and the case main body 2 is pressed constantly by the top surface of the case main body 2 and the tape receiving recess 20 of the bezel 3. The double coated adhesive tape 18 which is pressed as described above can provide an air tightness between the bezel 3 and the case main body 2.

[Second Embodiment]

Now, a wrist watch with an auto time adjusting function by an electric wave, the wrist watch using a wrist watch case in accordance with a second embodiment of the present invention, will be described with reference to FIG. 3. In this description, the same structural elements as those in the first embodiment shown in FIGS. 1 and 2 are designated by the same reference numerals which are used to designate the same structural elements in the first embodiment as those in the second embodiment. Therefore, detailed descriptions of these structural elements will be omitted.

Figure 3:
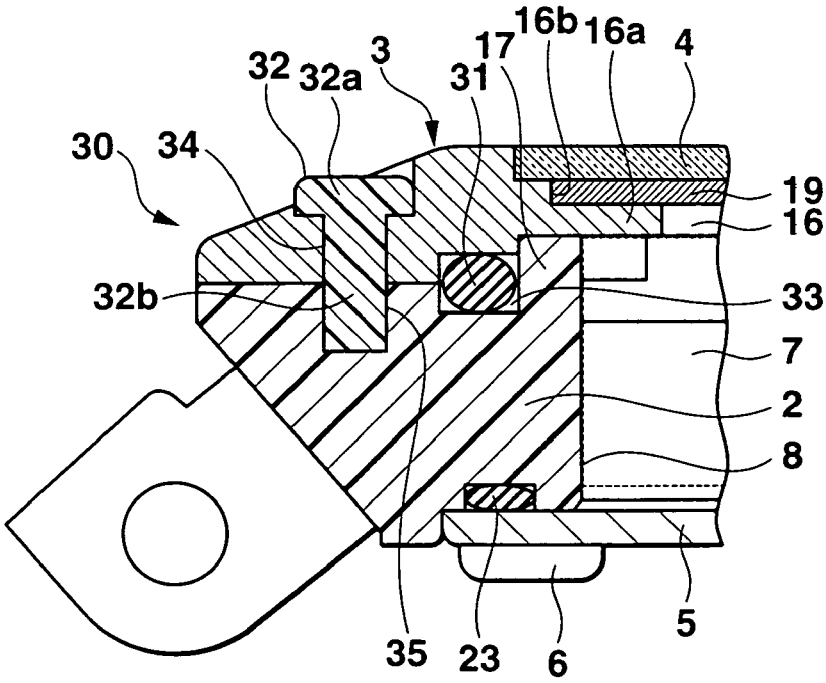
FIG. 3 is an enlarged vertical cross sectional view of an essential part of a wrist watch case in accordance with a second embodiment of the present invention.

In a watch case 30 of this wrist watch, as shown in FIG. 3, a water proof ring 31 is provided between the case main body 2 and the bezel 3, and the bezel 3 is fixed to the case main body 2 by a plurality of decorative members 32 made of a synthetic resin. The other structural elements in this embodiment are the same as those in the first embodiment.

In more detail, in the top surface of the case main body 2 and the bottom surface of the bezel 3, grooves 33 are formed to face each other along an outer periphery of the positioning projection 17 of the case main body 2, and the water proof ring 31 is provided in both of the grooves 33 facing each other. The diameter of the water proof ring 31 is greater than a total depth of both of the grooves 33.

Each of the decorative members 32 has a head 32*a* and a shaft 32*b*. The head 32*a* is arranged on the top surface of the bezel 3 and decorates the bezel 3. The shaft 32*b* is passed through a through hole 35 formed in the bezel 3 and then is inserted into a blind hole 35 formed in the top surface of the case main body 2. The distal end portion of the shaft 32*b* is fixed to the case main body 2 by an ultrasonic welding, so that the bezel 3 is fixed to the case main body 2.

Such a watch case 30 provides various technical advantages similar to those provided by the watch case 1 according to the first embodiment.

That is, since the decorative members 32 made of a synthetic resin are welded to the case main body 2 made of a synthetic resin with an ultrasonic wave, the bezel 3 on which the watch glass 4 and the solar panel 19 have been mounted in advance can be fixed easily and reliably to the case main body 2, as in the first embodiment.

Further, since the back cover 5 placed on the bottom surface of the case main body 2 is fixed to the bezel 3 by the plurality of fixing screws 6 and the water proof ring 31 is reliably pressed between the bezel 3 and the case main body 2, the pressed water proof ring 31 can provide an air tightness, i.e., a water proof property, between the bezel 3 and the case main body 2.

In the second embodiment, the bezel 3 is fixed to the case main body 2 by welding the decorative members 32 made of a synthetic resin and passed through the through holes 34 of the bezel 3 to the case main body 2 of a synthetic resin with an ultrasonic wave. However, the shaft 32*b* of the decorative member 32 may be configured to have a screw portion, and this screw portion may be screwed into the blind hole 35 of the case main body 2 to fix the bezel 3 on the case main body 2.

[Third Embodiment]

Now, a wrist watch with an auto time adjusting function by an electric wave, the wrist watch using a wrist watch case in accordance with a third embodiment of the present invention, will be described with reference to FIG. 4. In this description, the same structural elements as those in the first embodiment shown in FIGS. 1 and 2 are designated by the same reference numerals which are used to designate the same structural elements in the first embodiment as those in the third embodiment. Therefore, detailed descriptions of these structural elements will be omitted.

Figure 4:
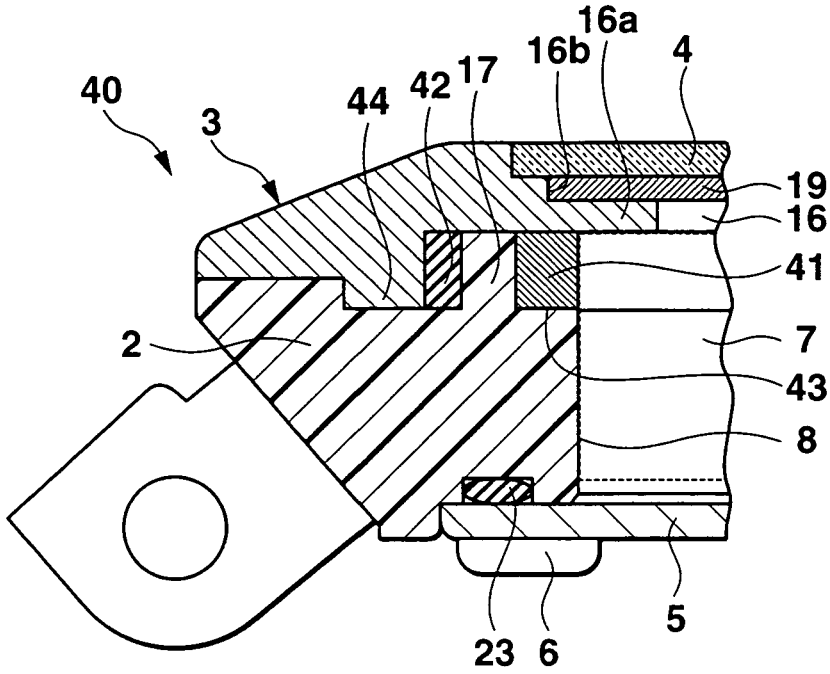
FIG. 4 is an enlarged vertical cross sectional view of an essential part of a wrist watch case in accordance with a third embodiment of the present invention.

In the watch case 40 of this wrist watch, as shown in FIG. 4, a metallic ring member 41 which surrounds the top opening of the module housing portion 8 is provided in the top surface of the case main body 2, and the bezel 3 is press-fitted onto a portion of the case main body 2 corresponding to an outer periphery of the ring member with a ring shaped packing 42 therebetween. The other structural elements in this embodiment are the same as those in the first embodiment.

In more details, a ring member receiving recess 43 is provided between the positioning projection 17 and the peripheral edge of the top opening of the module housing portion 8 in the top surface of the case main body 2, and the ring member 41 is embedded in the ring receiving recess 43. The ring member 41 is formed of a metal with a high rigidity such as stainless steel, and reinforces the case main body 2 made of a synthetic resin. The ring shaped packing 42 is arranged at an outer periphery of the positioning projection 17 on the top surface of the case main body 2, and a packing abutting portion 44 is provided on the bottom surface of the bezel 3 to correspond to an outer periphery face of the packing 42.

Such a watch case 40 provides various technical advantages similar to those provided by the watch case 1 according to the first embodiment. Further, the metallic ring member 41 is provided in the inside of the positioning projection 17 on the top surface of the case main body 2, the packing 42 is provided on the outer periphery of the positioning projection 17 on the top surface of the case main body 2, and the bezel 3 is mounted on the top surface of the case main body 2 to make the packing abutting portion 44 of the bezel 3 press the packing 42 against the positioning projection 17. During this press fit, the metallic ring member 41 prevents a deformation of the positioning projection 17, i.e., the case main body 2 made of a synthetic resin.

With this structure, an air tightness, i.e., a water proof property, between the bezel 3 and the case main body 2 can be obtained well by the packing 42, and a rigidity of the case main body 2 made of a synthetic resin can be reinforced by the metallic ring member 41.

[Modification of Third Embodiment]

Figure 5:
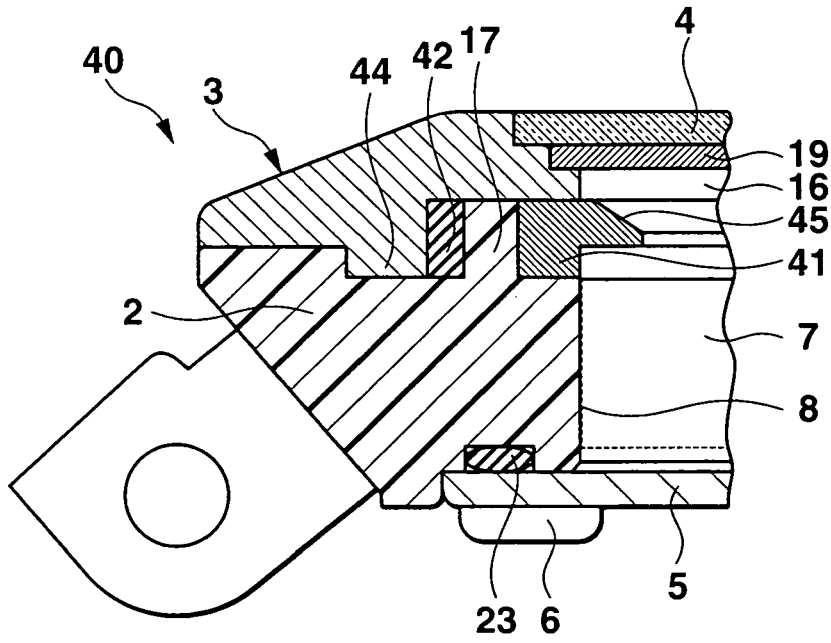
FIG. 5 is an enlarged vertical cross sectional view of an essential part of a modification of the wrist watch case according to the third embodiment.

In this modification, as shown in FIG. 5, an inclined portion 45 is formed on an inner periphery of the ring member 41. The inclined portion 45 of the ring member 41 can be used as a parting member that surrounds the periphery of the watch module 7. Since such an inclined portion 45 of the ring member 41 makes the watch case 40 need not an independent parting member, the number of structural elements of the watch case 40 can be reduced.

[Fourth Embodiment]

Now, a wrist watch with an auto time adjusting function by an electric wave, the wrist watch using a wrist watch case in accordance with a fourth embodiment of the present invention, will be described with reference to FIGS. 6 to 10. In this description, the same structural elements as those in the first embodiment shown in FIGS. 1 and 2 are designated by the same reference numerals which are used to designate the same structural elements in the first embodiment as those in the third embodiment. Therefore, detailed descriptions of these structural elements will be omitted.

The wrist watch case 50, like the wrist watch case 1 of the first embodiment, comprises: the annular case main body 2 which is made of a synthetic resin and which has the top and bottom openings; the metallic bezel 3 which is mounted on the top surface of the case main body 2 and which surrounds the top opening of the case main body 2; the watch glass 4 mounted in the center opening of the bezel 3; the metallic back cover 5 which is mounted on the bottom surface of the case main body 2 and which covers the bottom opening of the case main body 2; and the fixing unit which has the plurality of fixing screws 6 for fixing the back cover 5 and the bezel 3 with each other while sandwiching the case main body 2 between the back cover 5 and the bezel 3.

The watch case 50 further comprises: a water proof ring 51 arranged between the case main body 2 and the bezel 3; and a plurality of fixing screws 52 for fixing the case main body 2 and the bezel 3 to each other.

Figure 6:
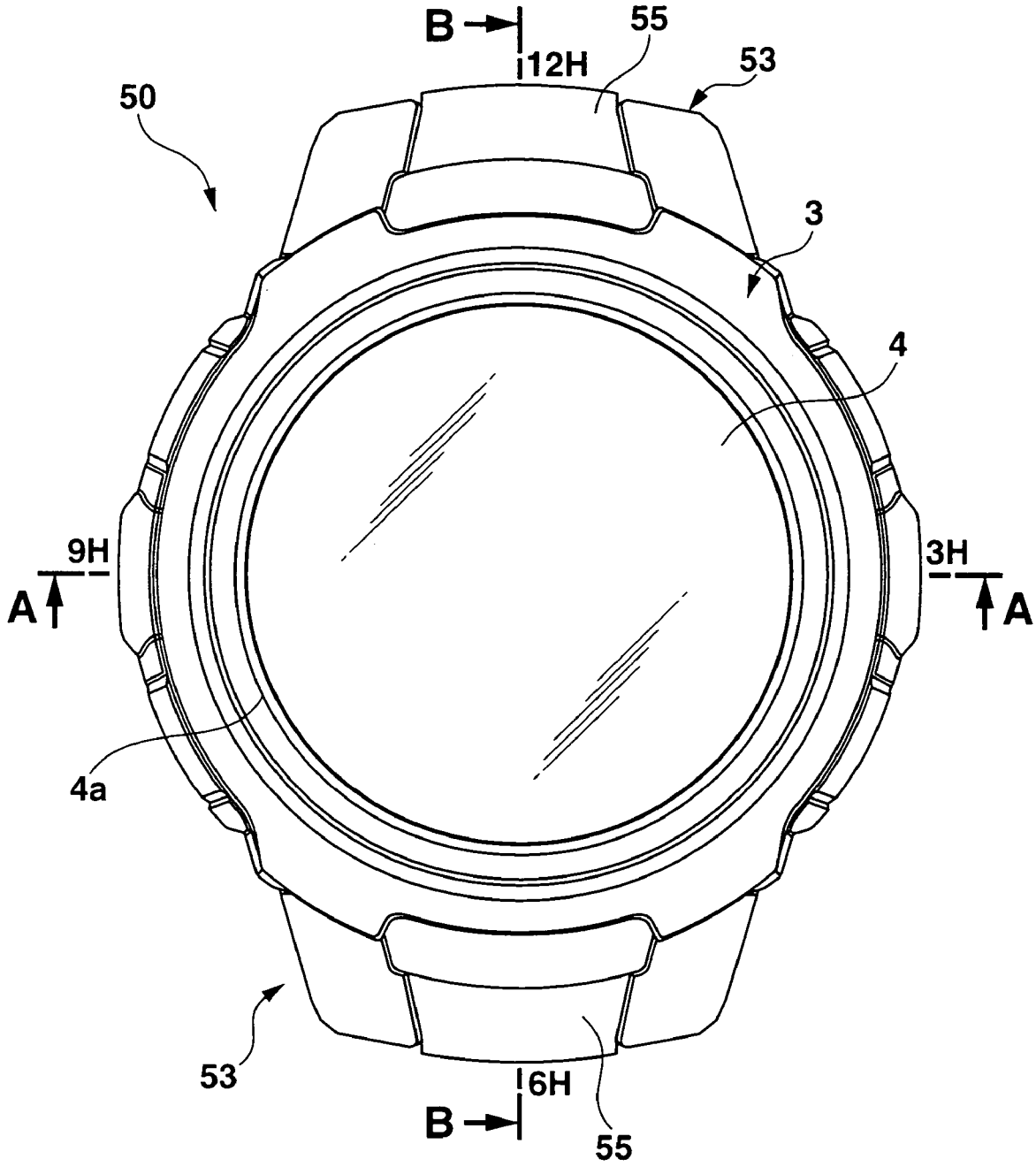
FIG. 6 is a plan view of a wrist watch with an auto time adjusting function by an electric wave, the wrist watch using a wrist watch case in accordance with a fourth embodiment of the present invention.
Figure 7:
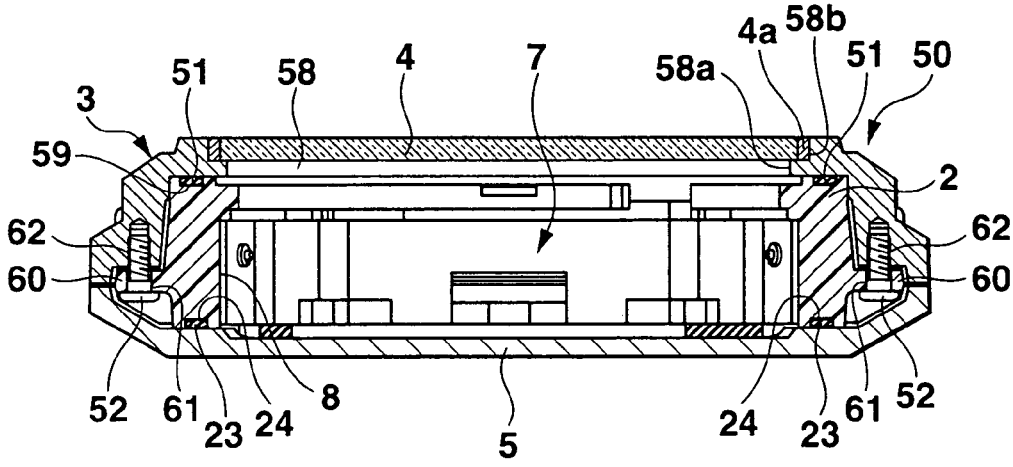
FIG. 7 is a vertical cross sectional view taken along the line A—A of FIG. 6.
Figure 8:
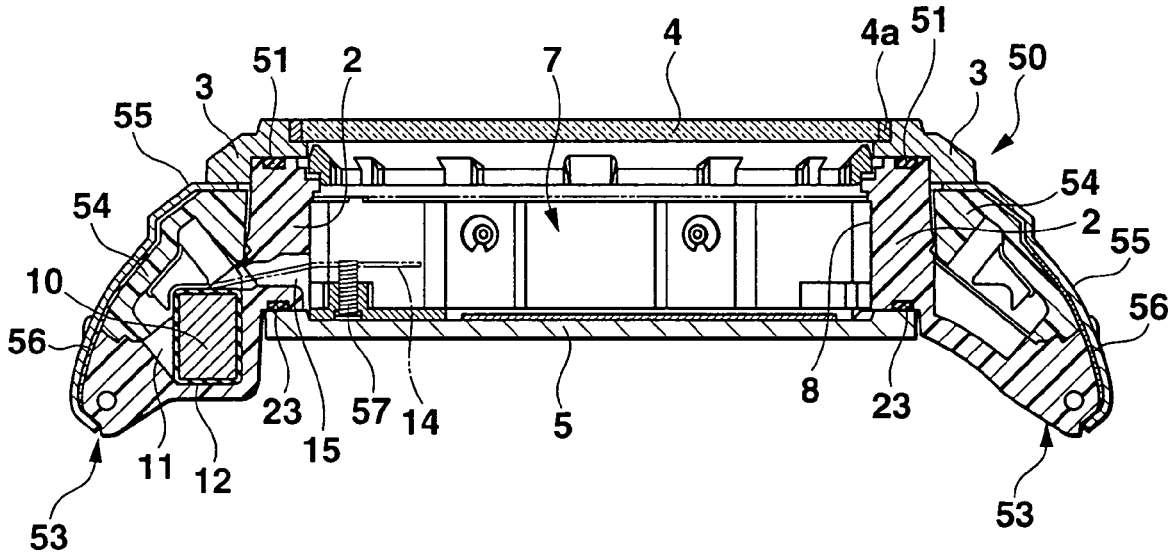
FIG. 8 is a vertical cross sectional view taken along the line B—B of FIG. 6.
Figure 9:
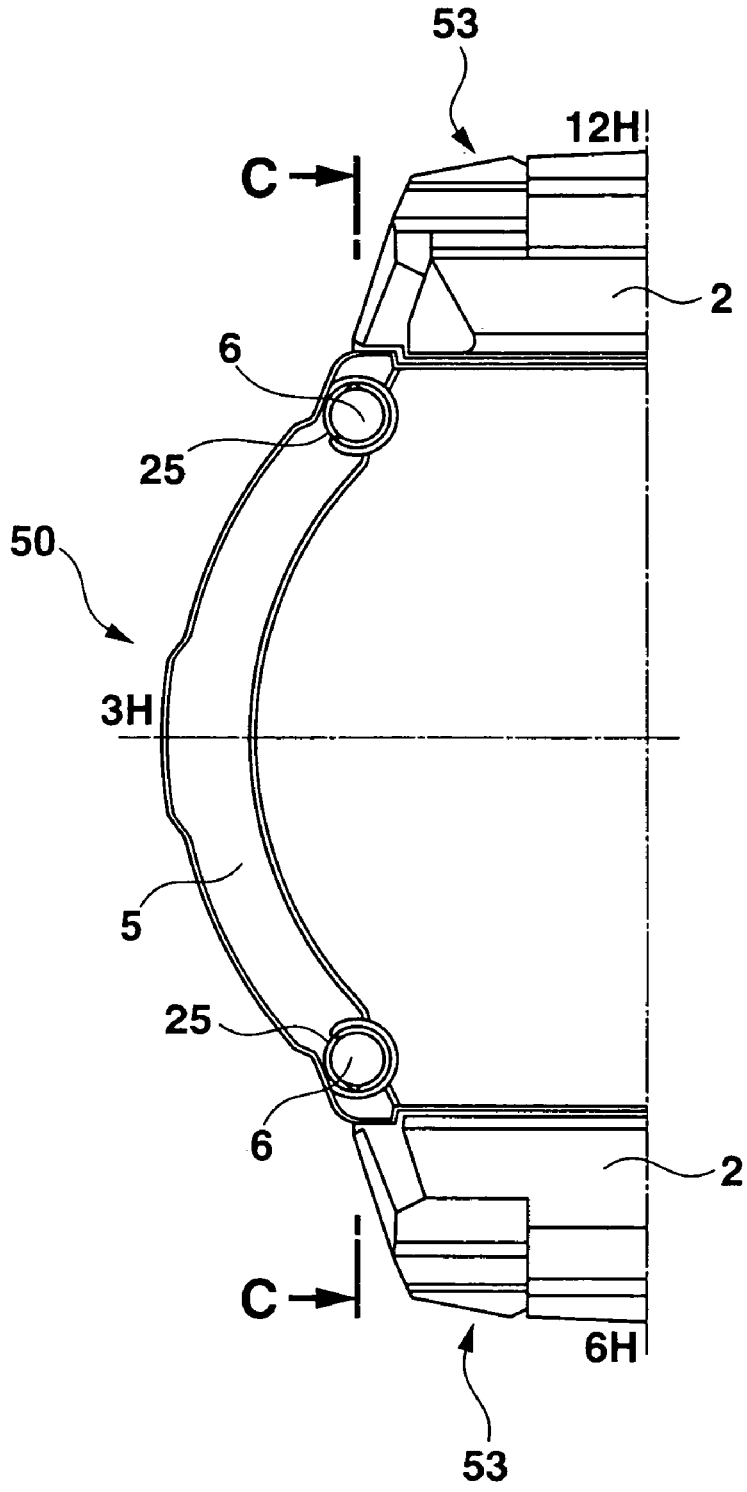
FIG. 9 is a partial bottom view of the wrist watch of FIG. 6, in which the half of the bottom surface of the wrist watch of FIG. 6 located at a three O'clock side is shown.

The case main body 2 is made of, for example, an ABS resin, as in the case main body 2 of the first embodiment. As shown in FIGS. 7 and 8, the module housing portion 8 for housing the watch module 7 is provided in the center portion of the case main body 2. The module housing portion 8 opens on the top and bottom surfaces of the case main body 2. A pair of band attaching portions 53 is provided on the 12 'O clock and 6 O'clock sides of the case main body 2 and extend laterally and outwardly from the bezel 3, as shown in FIGS. 6 and 8. An upwardly opened recess is formed in each of these band attaching portions 53, and the top openings of the recesses of the band attaching portions 53 are covered with cover members 54 made of a synthetic resin. Decorative thin metal plates 55 such as, for example, stainless steel are adhesively bonded on the top surfaces of the cover members 54 made of a synthetic resin and the top surfaces of the band attaching portions 53, by double coated adhesive tapes 56.

The recess of the band attaching portion 53 positioned at the 12 O'clock side of the case main body 2 functions as the antenna containing area 11 for containing the antenna 10, as shown in FIG. 8. The antenna 10 is enveloped by the buffer member 12 such as, for example, a rubber and is contained in the antenna containing area 11. The communication passage 15 which communicates the antenna containing area 11 with the module housing portion 8 is provided in the case main body 2. The connection lead 14 extending from the antenna 10 toward the watch module 7 housed in the module housing portion 8 is arranged in the communication passage 15, and an extension end of the connection lead 14 is electrically connected to the watch module 7 by a coil spring 57.

Figure 10:
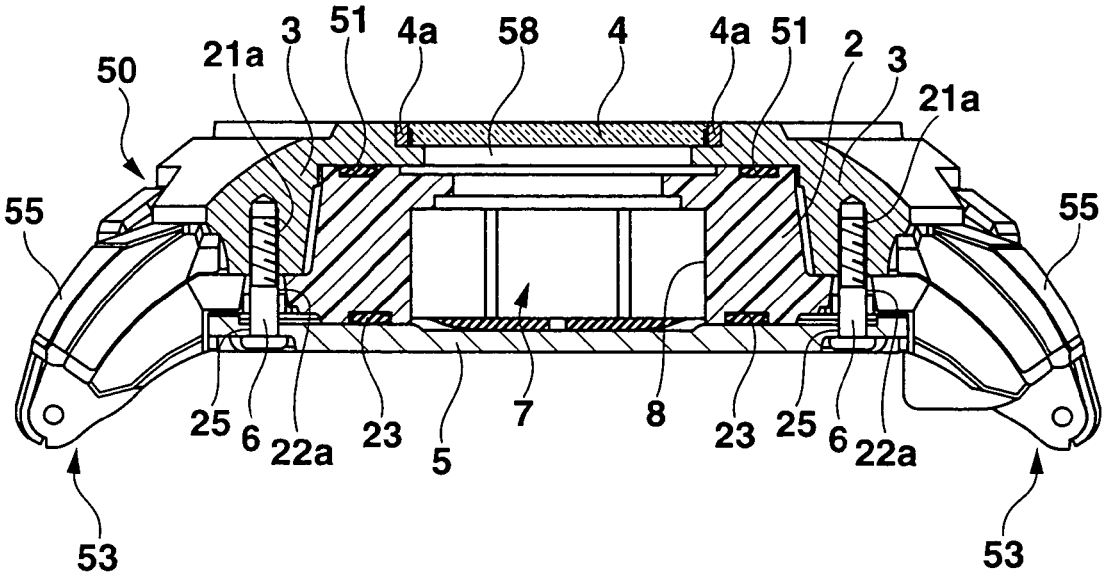
FIG. 10 is a vertical cross sectional view taken along the line C—C of FIG. 9.

The bezel 3 is formed of a metal with a high rigidity such as, for example, a stainless steel and has an opening 58 which corresponds to the top opening of the module housing portion 8 of the case main body 2 in the center portion of the bezel 3, as shown in FIGS. 7 and 8. The bezel 3, as shown in FIGS. 7, 8, and 10, is configured to have a substantially cylindrical shape, so that the bezel 3 covers the top surface and periphery of the case main body 2 with excluding the band attaching portions 53. As shown in FIG. 7, an inner flange 58*a* is formed at the lower portion of the inner periphery of the opening 58 of the bezel 3, and a watch glass mounting portion 58*b* is formed at the upper side of the inner flange 58*a* on the inner periphery of the opening 58. The inner diameter of the watch glass mounting portion 58*b* is greater than that of the inner flange 58*b*. The watch glass 4 is mounted on the glass mount portion 58*b* with a packing 4*a* being sandwiched therebetween.

As shown in FIGS. 7 and 8, a water proof ring receiving groove 59 is formed on the top surface of the case main body 2 to have a ring shape along the periphery of the top opening of the module housing portion 8, and the water proof ring 51 is received in the water proof ring receiving groove 59. The water proof ring 51 is formed of a material which has elasticity such as, for example, a rubber, and the upper portion of the water proof ring 51 protrudes slightly from the top surface of the case main body 2 in the upward direction. The upwardly protruding portion of the water proof ring 51 in the water proof ring receiving groove 59 comes into intimate contact with the bottom surface of the bezel 3. The bezel 3, as shown in FIG. 7, is fixed to the case main body 2 by the plurality of fixing screws 52 inserted into the case main body 2 from the bottom surface thereof.

In more detail, fixing projections 60 are provided at each of the 3 O'clock and 9 O'clock sides of the lower portion of the outer periphery of the case main body 2, and a through hole 61 is formed in each of the fixing projections 60 to pass through the fixing projection 60 vertically. Screw holes 62 are formed in the bottom surface of the bezel 3 to correspond to the through holes 61 of the fixing projections 60 of the case main body 2.

While the bezel 3 is mounted on a predetermined position of the top surface of the case main body 2, the fixing screws 52 are inserted into the through holes 61 of the fixing projections 60 from the lower side of the case main body 2 and the fixing screws 52 are screwed into the screw holes 62 of the bezel 3. As a result of this manner, the bezel 3 is fixed to the case main body 2 with the water proof ring 51 on the top surface of the case main body 2 being pressed.

The back cover 5 is made of a metal with a high rigidity such as, for example, a stainless steel or a titanium, and the back cover has a substantially flat shape as shown in FIGS. 8 and 10. The back cover 5 is fixed on the bottom surface of the case main body 2 by the plurality of fixing screws 6 with the water proof ring 23 being sandwiched therebetween and covers the bottom opening of the module housing portion 8 of the case main body 2. The water proof ring 23 is arranged in the ring shaped groove 24 formed in the bottom surface of the case main body 2 along the periphery of the bottom opening of the module housing portion 8, and is pressed resiliently by the top surface of the back cover 5.

The plurality of fixing screws 6 are arranged at two positions in each of two portions of the back cover 5, the two portions corresponding to the 3 O'clock side (see FIG. 9) and 9 O'clock side (not shown) of the bottom surface of the case main body 2. In this embodiment, the two positions in one portion of the back cover 5 which corresponds to the 3 O'clock side (see FIG. 9) of the bottom surface of the case main body 2 correspond to the 1 O'clock and 5 O'clock positions of the bottom surface of the case main body 2, and the two positions in another portion of the back cover 5 which corresponds to the 9 O'clock side (not shown) of the bottom surface of the case main body 2 correspond to the 11 O'clock and 7 O'clock positions of the bottom surface of the case main body 2.

As shown in FIG. 10, these fixing screws 6 are inserted into the through holes 25 formed at the above-described four positions of the back cover 5 from the bottom side thereof, and are passed through the four through holes 22*a* formed in the proximal end portions of the two band attaching portions 53 while the two through holes 22*a* are arranged at both ends in the proximal end portion of one band attaching portion 53 in the peripheral direction of the case main body 2 and the remained two through holes 22*a* are arranged at both ends in the proximal end portion of another band attaching portion 53 in the peripheral direction of the case main body 2. And, the distal end portions of these fixing screws 6 are finally screwed into the screw holes 21*a* formed in the bottom surface of the bezel 3 to correspond to the through holes 22*a* of the proximal end portions of the two band attaching portions 53.

As a result, the plurality of fixing screws 6 fix the bezel 3 and the back cover 5 with each other with the case main body 2 being sandwiched between the bezel 3 and the back cover 5.

Now, an assembly of the wrist watch as described above will be described.

At first, as shown in FIG. 8, the antenna 10 overlapped with the buffer member 12 is contained in the antenna containing area 11 provided in the band attaching portion 53 located at the 12 O'clock side of the case main body 2. In addition, the connection lead 14 of the antenna 10 is inserted into the module housing portion 8 of the case main body 2 through the communication passage 15 of the case main body 2. Next, the top openings of the recesses in the band attaching portions 53 are covered by the cover members 54 made of a synthetic resin. Further, the metal plates 55 are adhesively bonded on the top surface of the cover members 54 and that of the band attaching portions 53 by the double coated adhesive tapes 56.

Next, the water proof ring 51 is arranged in the water proof ring receiving groove 59 formed in the top surface of the case main body 2, and then the bezel 3 is placed on the top surface of the case main body 2.

Next, as shown in FIG. 7, the fixing screws 52 are inserted from the bottom side of the case main body 2 into the through holes 61 of the plurality of fixing projections 60 provided at the lower portion of the outer periphery of the case main body 2, and are screwed into the plurality of screw holes 62 of the bezel 3 so that the bezel 3 is fixed to the case main body 2. With this fixation, the water proof ring 51 is pressed and sandwiched between the top surface of the case main body 2 and the bottom surface of the bezel 3. Next, the watch glass 4 is mounted on the watch glass mounting portion 58*b* formed in the opening 58 of the bezel 3.

Next, after the case main body 2, together with the bezel 3, has been inverted upside down, the watch module 7 is housed in the module housing portion 8 of the case main body 2 through the bottom opening of the module housing portion 8, and the connection lead 14 of the antenna 10 is electrically connected to the watch module 7 by the coil spring 57.

Next, the water proof ring 23 is arranged in the ring shaped groove 24 provided in the bottom surface of the case main body 2, and further, the back cover 5 is placed on the bottom surface of the case main body 2 to cover the bottom opening of the module housing portion.

And finally, the fixing screws 6 are inserted from the bottom side of the back cover 5 into the plurality of through holes 25 of the back cover 5, and are passed through the plurality of through holes 22*a* of the case main body 2. The distal end portions are screwed into the plurality of screw holes 21*a* in the bottom surface of the bezel 3, so that the bezel 3 and the back cover 5 are fixed to each other with the case main body 2 being sandwiched between the bezel 3 and the back cover 5. And, the assembly of the wrist watch terminates.

As described above, in the watch case 50 of the wrist watch with an auto time adjusting function by an electric wave of the present embodiment, even if the case main body 2 is made of a synthetic resin, a rigidity required for the watch case 50 can be obtained by the metallic bezel 3 and the metallic back cover 5, so that the entire watch case 1 can be configured to have a thin thickness.

In addition, the antenna containing area 11 is provided in one of the pair of band attaching portions 53 which are formed on the case main body 2 made of a synthetic resin to extend laterally and outwardly from the bezel 3, and the antenna 10 which is enveloped with the buffer member 12 is contained in the antenna containing area 11. Therefore, the antenna 10 can be located laterally and outwardly from the metallic bezel 3 and the metallic back cover 5. With this configuration, the antenna 10 can receive an electric wave including a time data well and reliably without being affected by the metal bezel 3 and the metal back cover 5. Although the top surface of the cover member 54 made of a synthetic resin which covers the top opening of the antenna containing area 11 is overlapped with the thin metal plate 55, portions of the top surface of the one band attaching portion 53 other than the top opening of the antenna containing area 11, i.e., both sides and the bottom surface of the one band attaching portion 53, are directly exposed to an external space. Therefore, the antenna 10 is not affected by the thin metal plate 55.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A wrist watch case comprising:

a case main body made of a synthetic resin, in which a housing portion with top and bottom openings is formed;

a pair of band attaching portions which project from the case main body, and at least one of which comprises an antenna containing area;

a metallic sheath member which is mounted on a top surface of the case main body and has an opening corresponding to the housing portion, and which does not cover the antenna containing area of the at least one of the band attaching portions;

a light transmitting member which is mounted on the opening of the sheath member;

a metallic back cover which covers the bottom opening of the housing portion of the case main body;

a fixing unit which fixes the sheath member and the back cover to each other while sandwiching the case main body therebetween;

a cover which is made of a synthetic resin and which covers the antenna containing area; and a thin metal plate which covers a top surface of the cover and a top surface of the at least one of the band attaching portions.

2. A wrist watch case according to claim 1, wherein the case main body and the sheath member are adhesively bonded to each other by a double coated adhesive tape.

3. A wrist watch case according to claim 1, further comprising:

a decorative member including a head and a shaft; and a water proof ring arranged between the case main body and the sheath member;

wherein the head of the decorative member is exposed on an outer surface of the sheath member, the sheath member has a through hole into which the shaft of the decorative member is inserted, and a distal end portion of the shaft of the decorative member is fixed to the case main body so that the sheath member is fixed to the case main body.

4. A wrist watch case according to claim 1, further comprising:

a metallic ring member which surrounds the top opening of the housing portion and which is provided in the top surface of the case main body;

wherein the sheath member is press-fitted onto a portion of the case main body corresponding to an outer periphery of the ring member with a packing provided between the sheath member and said portion of the case main body.

5. A wrist watch case according to claim 1, further comprising:

a water proof ring which is provided between the sheath member and the case main body; and a second fixing unit which is provided between the back cover and the case main body, the second fixing unit fixing the case main body and the sheath member to each other.

6. A wrist watch case according to claim 1, wherein the antenna containing area is formed in one of the band attaching portions located at a 12 O'clock side of the case main body.

7. A wrist watch case according to claim 1, wherein the fixing unit includes a screw.

8. A wrist watch with a function of automatically adjusting a time in accordance with an electric wave, comprising:

(i) a wrist watch case including:

a case main body made of a synthetic resin, in which a housing portion with top and bottom openings is formed;

a pair of band attaching portions which project from the case main body, and at least one of which comprises an antenna containing area and a communication passage which communicates the antenna containing area and the housing portion with each other;

a metallic sheath member which is mounted on a top surface of the case main body and has an opening corresponding to the housing portion, and which does not cover the antenna containing area of the at least one of the band attaching portions;

a light transmitting member which is mounted on the opening of the sheath member;

a metallic back cover which covers the bottom opening of the housing portion of the case main body;

a fixing unit which fixes the sheath member and the back cover to each other while sandwiching the case main body therebetween;

a cover which is made of a synthetic resin and which covers the antenna containing area; and a thin metal plate which covers a top surface of the cover and a top surface of the at least one of the band attaching portions;

(ii) a watch module which is housed in the housing portion of the case main body;

(iii) an antenna which is contained in the antenna containing area; and (iv) a lead which extends through the communication passage to connect the antenna to the watch module.

9. A wrist watch according to claim 8, wherein the antenna containing area is formed in one of the band attaching portions located at a 12 O'clock side of the case main body.

10. A wrist watch according to claim 8, wherein the antenna is configured to receive a long wave which includes time data.

11. A wrist mountable electronic device case, comprising:

a case main body made of a synthetic resin, in which a housing portion with top and bottom openings is formed;

a pair of band attaching portions which project from the case main body, and at least one of which comprises an antenna containing area;

a metallic sheath member which is mounted on a top surface of the case main body and has an opening corresponding to the housing portion, and which does not cover the antenna containing area of the at least one of the band attaching portions;

a light transmitting member which is mounted on the opening of the sheath member;

a metallic back cover which covers the bottom opening of the housing portion of the case main body;

a fixing unit which fixes the sheath member and the back cover to each other while sandwiching the case main body therebetween;

a cover which is made of a synthetic resin and which covers the antenna containing area; and a thin metal plate which covers a top surface of the cover and a top surface of the at least one of the band attaching portions.

12. A wrist mountable electronic device case according to claim 11, wherein the case main body and the sheath member are adhesively bonded to each other by a double coated adhesive tape.

13. A wrist mountable electronic device case according to claim 11, further comprising:

a metallic ring member which surrounds the top opening of the housing portion and which is provided in the top surface of the case main body;

wherein the sheath member is press-fitted onto a portion of the case main body corresponding to an outer periphery of the ring member with a packing provided between the sheath member and said portion of the case main body.

14. A wrist mountable electronic device case according to claim 11, further comprising:

a water proof ring which is provided between the sheath member and the case main body; and a second fixing unit which is provided between the back cover and the case main body, the second fixing unit fixing the case main body and the sheath member to each other.

15. A wrist mountable electronic device case according to claim 11, wherein the antenna containing area is formed in one of the band attaching portions located at a 12 O'clock side of the case main body.

16. A wrist mountable electronic device case according to claim 11, wherein the fixing unit includes a screw.

* * * * *